US005924587A

United States Patent [19]

Landman

[11] Patent Number: 5,924,587

[45] Date of Patent: Jul. 20, 1999

[54] PERFORMANCE ORIENTED SHIPPING CONTAINER

[75] Inventor: Charles W. Landman, Callao, Va.

[73] Assignee: The United States of America as represented by the Secretary of the Navy, Washington, D.C.

[21] Appl. No.: 08/914,018

[22] Filed: Aug. 11, 1997

[51] Int. Cl.[6] ..... B65D 8/04

[52] U.S. Cl. ..... 217/36; 217/65

[58] Field of Search ..... 217/36, 5, 65, 217/37, 40, 17

[56] References Cited

U.S. PATENT DOCUMENTS

| | | | |
|---|---|---|---|
| 1,704,118 | 5/1929 | Babcock . | |
| 2,117,194 | 5/1938 | McElroy | 217/36 |
| 2,294,279 | 8/1942 | Carnwath | 217/5 |
| 2,351,092 | 6/1944 | Bauer | 217/36 |
| 2,809,746 | 10/1957 | Lankford | 217/36 |
| 2,835,381 | 5/1958 | Ackermann et al. | 206/65 |
| 2,895,604 | 7/1959 | Schwartz | 217/36 |
| 3,465,909 | 9/1969 | Toman et al. | 217/5 |
| 4,286,708 | 9/1981 | Porzel | 206/3 |
| 5,622,306 | 4/1997 | Grigsby, Sr. | 217/36 |

*Primary Examiner*—Joseph M. Moy
*Attorney, Agent, or Firm*—James B. Bechtel, Esq.

[57] ABSTRACT

A container comprises bottom, left and right side, front, back and top assemblies. The side, front, back and top assemblies have a rectangular sheet with a batten frame affixed to the perimeter of a first face thereof and coincident with the edges thereof. The bottom assembly has a rectangular sheet with a base frame affixed to the perimeter of a bottom face thereof. The base frame extends beyond the perimeter of the sheet to form a circumferential extension dimensioned therearound to be equal to the thickness of the sheet used in the other assemblies plus the thickness of the batten frame. During construction of the container, each assembly is glued and stapled prior to being glued and screwed to other assemblies. The side, back and front assemblies are arranged to form a rectangular tube with an inner surface defined entirely by the side, back and front assemblies' sheet. The bottom assembly is positioned with its sheet fitting into the rectangular tube such that the circumferential extension can be glued/screwed to lower portions of the side, front and back assemblies. The top assembly is positioned with its sheet abutting upper portions of the side, front and back assemblies, and is glued/screwed thereto.

7 Claims, 4 Drawing Sheets

FIG.3
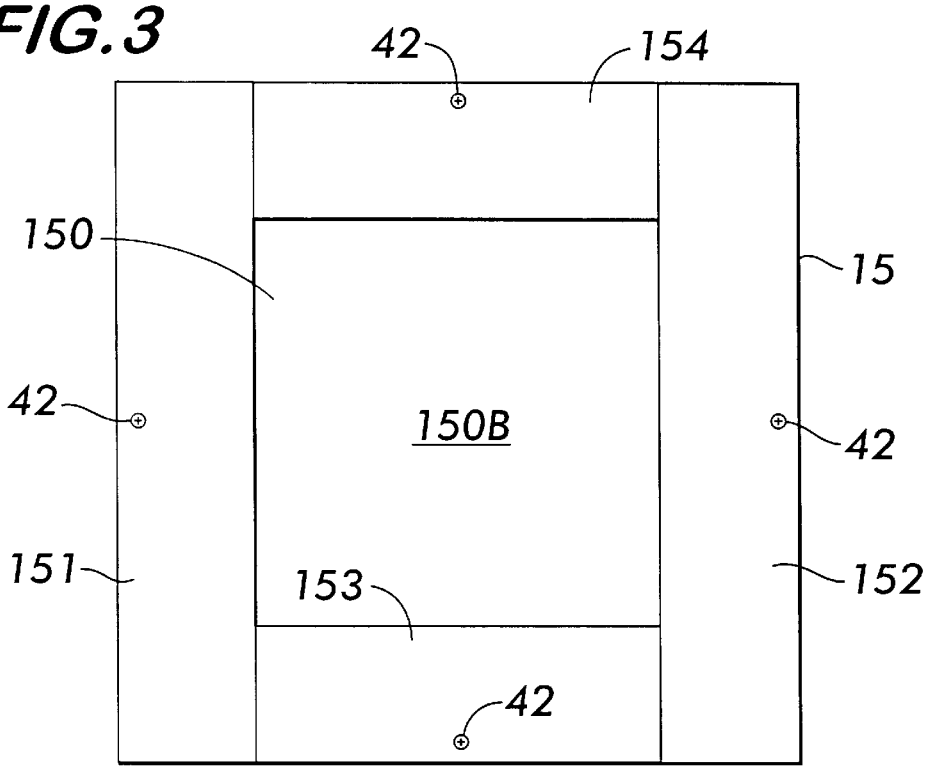
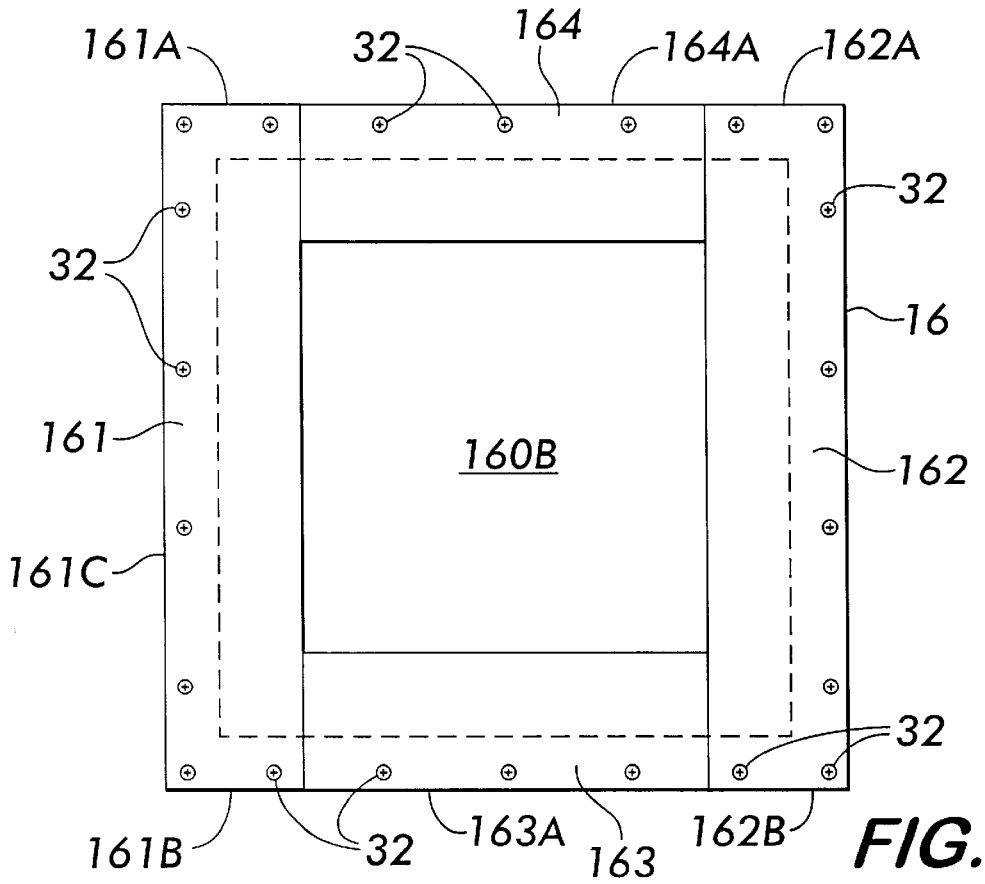
FIG.4

FIG. 5
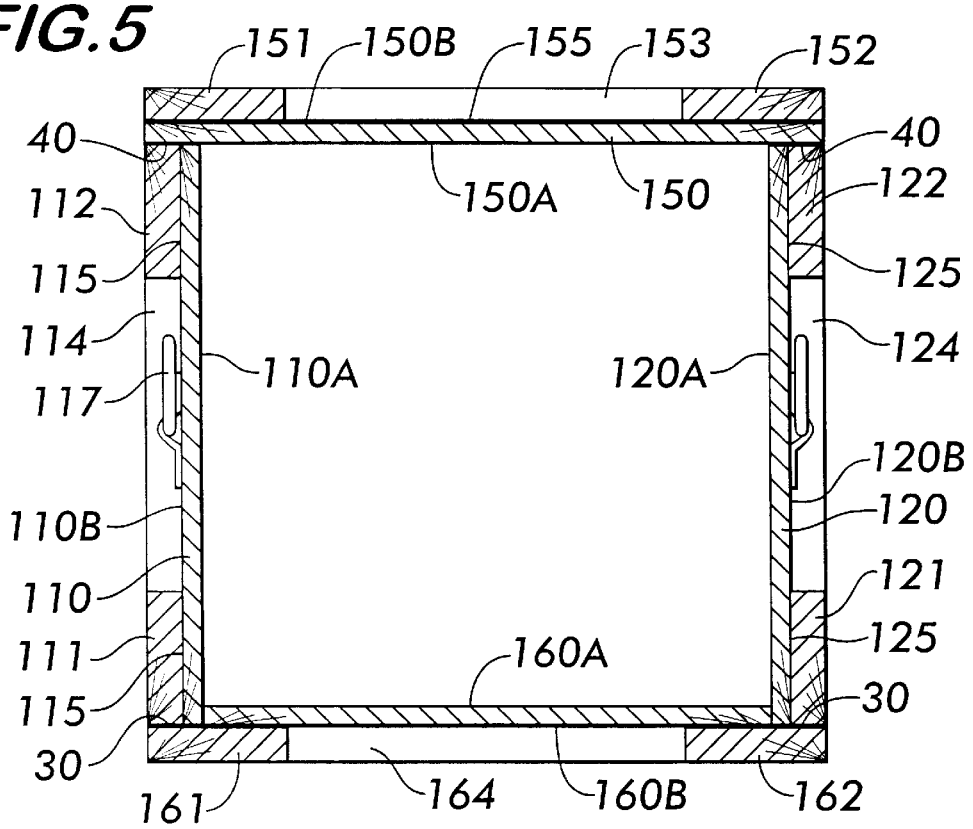
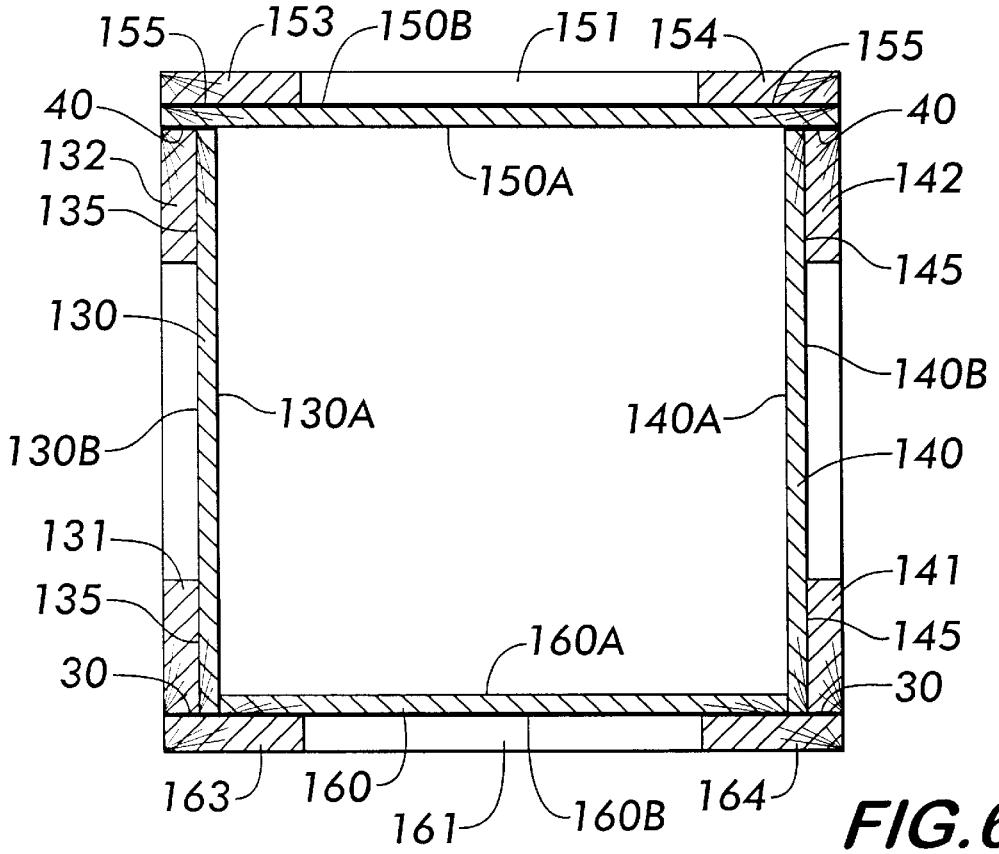
FIG. 6

PERFORMANCE ORIENTED SHIPPING CONTAINER

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The invention relates generally to containers, and more particularly to a shipping container capable of meeting all performance criteria specified in Title 49, Part 178 of the United States Code of Federal Regulations.

BACKGROUND OF THE INVENTION

Before packaging hazardous materials such as explosives and/or ordnance, each branch of the United States military must be sure that the packaging container meets the performance criteria specified in Title 49, Part 178 of the United States Code of Federal Regulations. However, the various shapes and sizes of these hazardous materials has brought about a plurality of unique container designs, each of which must be tested in accordance with the strict performance requirements referred to above. Such design and testing is time-consuming and expensive.

SUMMARY OF THE INVENTION

Accordingly, it is an object of the present invention to provide a container that can be used to package a wide variety of hazardous materials for safe transportation.

Another object of the present invention is to provide a container that satisfies the performance criteria specified in Title 49, Part 178 of the United States Code of Federal Regulations.

Other objects and advantages of the present invention will become more obvious hereinafter in the specification and drawings.

In accordance with the present invention, a container comprises a bottom assembly, each of a left side assembly and a right side assembly attached to the bottom assembly, each of a front assembly and a back assembly attached to the bottom assembly and attached to each of the left side assembly and the right side assembly, and a top assembly attached to each of the left side assembly, right side assembly, front assembly and back assembly. Each of the left side assembly, right side assembly, front assembly, back assembly and top assembly have a rectangular first piece of sheet material with a batten frame affixed to the perimeter of a first face thereof and coincident with the edges thereof. The batten frame is defined by long battens spanning the length of the first piece of sheet material and short battens extending between and abutting the long battens. Each batten frame is glued to the first piece of sheet material and is stapled thereto by a plurality of staples driven through the first piece of sheet material from a second face thereof opposite the first face. Each of the long battens and short battens is of equal thickness. The bottom assembly has a rectangular second piece of sheet material with a base frame affixed to the perimeter of a bottom face thereof. The base frame extends beyond the perimeter of the second piece of sheet material to form a circumferential extension dimensioned thereabout to be equal to the thickness of the first piece of sheet material plus the thickness of one of the long battens and the short battens. The base frame is defined by long supports spanning beyond the length of the second piece of sheet material and short supports extending between and abutting either ends of the long supports. The base frame is glued to the second piece of sheet material and is stapled thereto by another plurality of staples driven through the second piece of sheet material from a top face thereof opposite the bottom face. The left side assembly, right side assembly, back assembly and front assembly are arranged to form a rectangular tube having an inner surface defined by each second face of each first piece of sheet material. The left side assembly is parallel to the right side assembly, and the front assembly is parallel to the back assembly. The left side assembly and right side assembly are glued inside the perimeter of the front assembly and back assembly such that external faces of the long battens and short battens of the left side assembly and right side assembly are coplanar with edges of the front assembly and back assembly. The bottom assembly is positioned with its second piece of sheet material fitting into the rectangular tube such that the circumferential extension can be glued to lower portions of the left side assembly, right side assembly, front assembly and back assembly. The first piece of sheet material of the top assembly is glued to upper portions of the left side assembly, right side assembly, front assembly and back assembly such that the long battens of the top assembly and long supports of the bottom assembly are perpendicular to the long battens of the front assembly and back assembly. A first plurality of screws pass through the circumferential extension of the bottom assembly and extend into the long battens at the lower portions of the left side assembly, right side assembly, front assembly and back assembly. A second plurality of screws pass through the long battens, short battens and first piece of sheet material of each of the front assembly and back assembly and extend into the long battens and short battens of the right side assembly and left side assembly. A third plurality of screws passing through the long battens, short battens and first piece of sheet material of the top assembly and extend into the long battens and short battens at the upper portions of the left side assembly, right side assembly, front assembly and back assembly.

BRIEF DESCRIPTION OF THE DRAWINGS

FIG. 3 is a top view of the container;

FIG. 4 is a bottom view of the container;

FIG. 5 is a cross-sectional view of the container taken along line 5—5 of FIG. 1; and FIG. 6 is a cross-sectional view of the container taken along line 6—6 of FIG. 2.

DETAILED DESCRIPTION OF THE INVENTION

Figure 1:
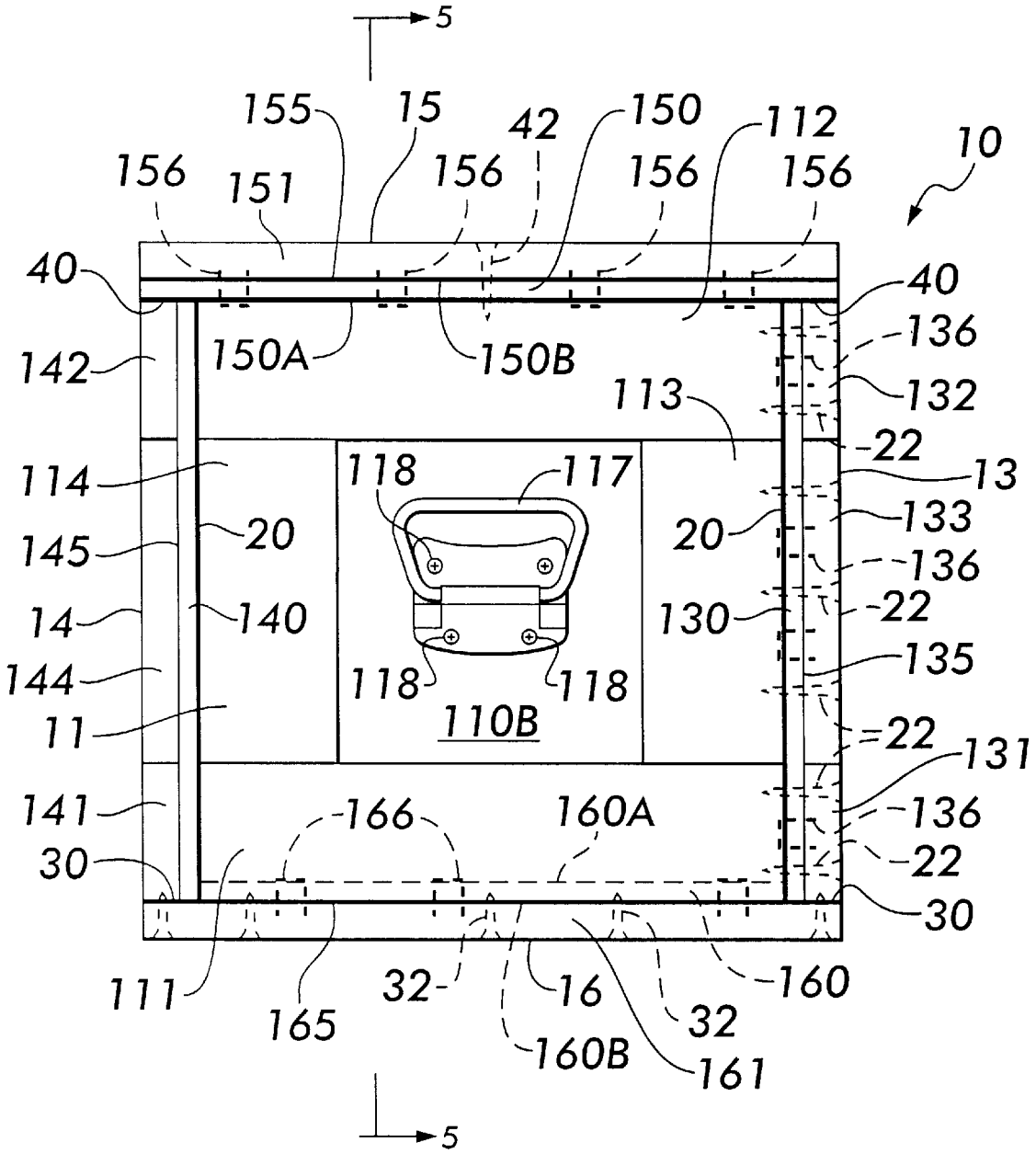
FIG. 1 is a side view of a container assembled in accordance with the present invention.
Figure 2:
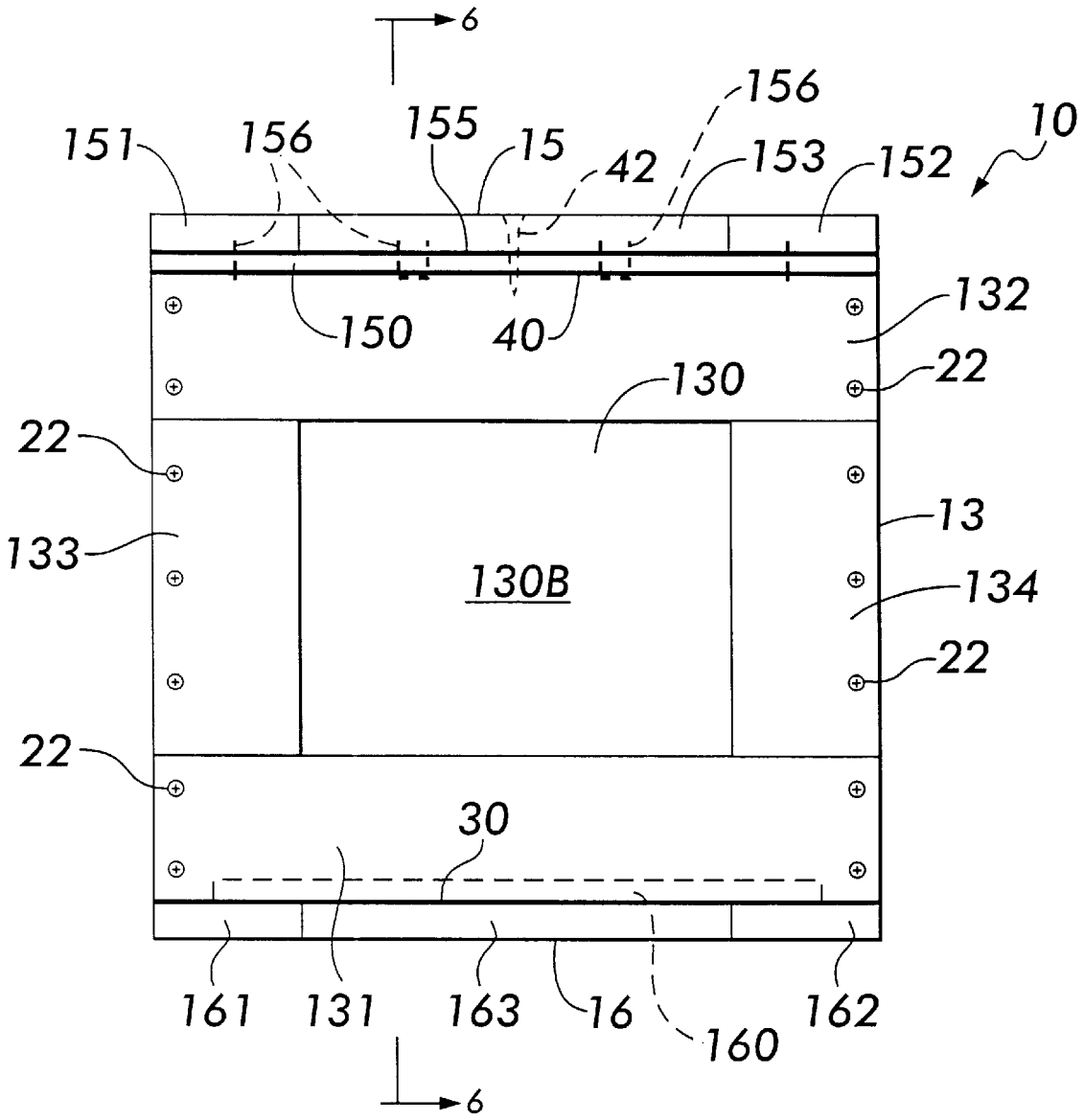
FIG. 2 is a front view of the container.

Referring now to the drawings, simultaneous reference will be made to FIGS. 1–6 in order to provide a complete understanding of the features of a container 10 assembled in accordance with the teachings of the present invention. In general, container 10 is constructed from six assemblies 11–16 to form a closed cubic or rectangular container 10. The six assemblies are the left and right side assemblies 11 and 12, the front and back assemblies 13 and 14, and the top and bottom assemblies 15 and 16. Prior to assembly as container 10, each of the six assemblies 11–16 is individually assembled in a similar fashion. Further, each of left and right side assemblies 11 and 12, front and back assemblies 13 and 14, and top assembly 15 have the same basic construction. Accordingly, it will be sufficient to detail the construction of, for example, top assembly 15 to provide an understanding of how each assemblies 11–15 is constructed. The drawings reflect this similarity of construction by using reference numerals ending with the same last digit for the analogous elements in each of assemblies 11–15. However, for clarity of illustration, not all the staples and screws referred to hereinafter are depicted for each assembly in each view of the drawings.

Top assembly 15 consists of a piece of sheet material 150 reinforced at its perimeter by an arrangement of battens framing and attached to one face thereof. More specifically, the arrangement consists of two longer battens 151 and 152 and two shorter battens 153 and 154. While a variety of construction materials could be used for sheet material 150 and battens 151–154, it will be assumed herein that sheet material 150 is plywood (e.g., half-inch, four-ply plywood) and battens 151–154 are cut from 1×4 pine stock. Long battens 151 and 152 are cut to match the length of sheet material 150 and are placed on opposite edges of sheet material 150 to be coincident therewith. Short battens 153 and 154 are cut in length to fit between and abut long battens 151 and 152. Short battens 153 and 154 are further placed on opposite ends of sheet material 150 to be coincident therewith. Each of battens 151–154 are glued, as indicated at 155, onto sheet material 150. Battens 151–154 are then stapled to sheet material 150 with staples 156 that are driven from the face 150A of sheet material 150 that is opposite the face 150B on which battens 151–154 are glued as indicated at 155.

Although following fabrication steps similar to those described above, bottom assembly 16 is a unique construction as will now be detailed. Bottom assembly 16 consists of a piece of sheet material 160 (e.g., plywood) reinforced about its perimeter by an arrangement of batten supports framing and attached to one face. While the sizing of sheet material 160 will be discussed further below, it is sufficient at this point in the description to say that sheet material 160 is smaller on all sides than each of sheet material 110, 120, 130, 140 and 150.

The arrangement of batten supports will ultimately form the base of container 10. More specifically, the batten support/base arrangement consists of two longer batten supports 161 and 162 and two shorter batten supports 163 and 164. Once again, assuming container 10 is to be of wood construction, batten supports 161 and 164 can be made of 1×4 pine stock. Long batten supports 161 and 162 are cut longer than the length of sheet material 160 and are placed/glued on opposite edges thereof. However, in contrast to all the other assemblies, a portion of each batten support extends beyond the perimeter of sheet material 160 to form a circumferential extension around sheet material 160 as best seen in FIGS. 4, 5 and 6. For example, ends 161A and 161B extend beyond the length of sheet material 160 while long side 161C of long batten support 161 extends beyond the edge of sheet material 160.

The amount of extension or overhang at side 161C and ends 161A and 161B is equivalent to the combined thickness of the sheet material (e.g., sheet 110) batten (e.g., long batten 111) of any one of the side assemblies 11 and 12, front assembly 13 or back assembly 14. Similarly, long batten support 162 is positioned and glued to have the same amount of extension at ends 162A and 162B and all along side 162C. Short batten supports 163 and 164 are cut in length to fit between abut long batten supports 161 and 162 at opposite ends of sheet material 160. Side 163A of short batten support 163 is positioned coincident with ends 161B and 162B. Side 164A of short batten support 164 is positioned coincident with ends 161A and 162A. Thus, each of short batten supports 163 and 164 extends along respective sides 163A and 164A by an amount equivalent to the combined thickness of the sheet material and batten of one of assemblies 11–15.

Each of batten supports 161–164 is glued to sheet material 160 as indicated at 165. Batten supports 161–164 are then stapled to sheet material 160 with staples 166 that are driven from the face 160A of sheet material 160 that is opposite the face 160B on which batten supports 161–164 are glued.

In assembling container 10, assemblies 11–14 are first arranged to form a rectangular tube with side assemblies 11 and 12 parallel to and opposing one another, and front and back assemblies 13 and 14 parallel to and opposing one another. Side assemblies 11 and 12 are placed between front and back assemblies 13 and 14 at right angles such that the exposed surfaces of the side assemblies' batten arrangements are coplanar with the abutting perimeter of the front and back assembly. Assemblies 11–14 so positioned are glued to one another as indicated at 20. Screws (e.g., galvanized wood screws in the case of a wooden container 10) are used to further secure assemblies 11–14 to one another. For the illustrated embodiment, screws 22 are driven through each of front and back assemblies 13 and 14 into the battens of side assemblies 11 and 12. For example, with respect to front assembly 13 and left side assembly 11, screws 22 are driven through battens 131–133 and sheet material 130 prior to being driven into battens 111–113 of left side assembly 11 (FIG. 1).

Once front and back assemblies 13 and 14 are glued and screwed to side assemblies 11 and 12, bottom assembly is attached to assemblies 11–14 as follows. Sheet material 160 is fitted within the rectangular tube formed by assemblies 11–14. For best performance, sheet material 160 is sized to nest within the rectangular tube formed by assemblies 11–14 while the extension portion of bottom assembly 16 (formed about the perimeter of sheet material 160) abuts the lower portion of each of assemblies 11–14. Glue, indicated at 30, is applied to the interface between the extension portion of bottom assembly 16 and the lower portion of assemblies 11–14. Screws 32 are then driven through bottom assembly 16 into the lower portions of assemblies 11–14. More specifically, screws 32 pass through the extension portion formed by support battens 161–164 and into long battens 111, 121, 131 and 141.

Finally, top assembly 15 is glued and screwed into place on assemblies 11–14. Glue, indicated at 40, is applied to the interface between sheet material 150 and the upper portion of assemblies 11–14. Screws 42 are then driven through battens 151–154 and sheet material 150 Before being driven into long battens 112, 122, 132 and 142. To facilitate handling of container 10, handles can be affixed to one or more sides of container 10. For example, handle 17 is shown affixed to sheet material 110 by means of screws 118. A similar handle (not shown) could be attached to the opposite side of container 10.

The advantages of the present invention are numerous. When assembled of plywood and pine battens/supports, the container of the present invention complies with all performance criteria (e.g., stack, vibration and drop tests) of Title 49, Park 178, of the United States Code of Federal Regulations. Further, the generally rectangular shape of the container's interior means that it can be used with a wide variety of hazardous material or ordnance shapes. Excess volume around the material or ordnance can simply be filled with an inert cushioning material such as those manufactured by Kimberly-Clark Corporation, Roswell, Ga. Thus, the present invention satisfies a great need of the United States military and will save unnecessary testing and expense in the years ahead.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A container comprising:

a bottom assembly;

each of a left side assembly and a right side assembly attached to said bottom assembly;

each of a front assembly and a back assembly attached to said bottom assembly and attached to each of said left side assembly and said right side assembly;

a top assembly attached to each of said left side assembly, said right side assembly, said front assembly and said back assembly;

each of said left side assembly, said right side assembly, said front assembly, said back assembly and said top assembly having a rectangular first piece of sheet material, said first piece of sheet material having a batten frame affixed to the perimeter of a first face thereof and coincident with the edges thereof, said batten frame defined by long battens spanning the length of said first piece of sheet material and short battens extending between and abutting said long battens, each said batten frame being glued to said first piece of sheet material and further being stapled thereto by a plurality of staples driven through said first piece of sheet material from a second face thereof opposite said first face, each of said long battens and said short battens being of equal thickness;

said bottom assembly having a rectangular second piece of sheet material with a base frame affixed to the perimeter of a bottom face thereof and extending beyond the perimeter thereof to form a circumferential extension dimensioned therearound to be equal to the thickness of said first piece of sheet material plus the thickness of one of said long battens and said short battens, said base frame defined by long supports spanning beyond the length of said second piece of sheet material and short supports extending between either ends of said long supports and abutting said long supports, said base frame being glued to said second piece of sheet material and further being stapled thereto by another plurality of staples driven through said second piece of sheet material from a top face thereof opposite said bottom face;

said left side assembly, said right side assembly, said back assembly and said front assembly arranged to form a rectangular tube having an inner surface defined by each said second face of each said first piece of sheet material with said left side assembly being parallel to said right side assembly and said front assembly being parallel to said back assembly, wherein said left side assembly and said right side assembly are glued inside the perimeter of said front assembly and said back assembly such that external faces of said long battens and said short battens of said left side assembly and said right side assembly are coplanar with edges of said front assembly and said back assembly;

said bottom assembly positioned with said second piece of sheet material fitting into said rectangular tube and with said circumferential extension glued to lower portions of said left side assembly, said right side assembly, said front assembly and said back assembly;

said first piece of sheet material of said top assembly glued to upper portions of said left side assembly, said right side assembly, said front assembly and said back assembly, wherein said long battens of said top assembly and said long supports of said bottom assembly are perpendicular to said long battens of said front assembly and said back assembly;

a first plurality of screws passing through said circumferential extension of said bottom assembly and further extending into said long battens at said lower portions of said left side assembly, said right side assembly, said front assembly and said back assembly;

a second plurality of screws passing through said long battens, said short battens and said first piece of sheet material of each of said front assembly and said back assembly, and further extending into said long battens and said short battens of said right side assembly and said left side assembly; and a third plurality of screws passing through said long battens, said short battens and said first piece of sheet material of said top assembly, and further extending into said long battens and said short battens at said upper portions of said left side assembly, said right side assembly, said front assembly and said back assembly.

2. A container as in claim 1 wherein each of said first piece of sheet material and said second piece of sheet material is plywood.

3. A container as in claim 1 wherein each of said long battens, said short battens, said long supports and said short supports is made of a strip of wood of rectangular cross-section.

4. A container as in claim 1 further comprising a handle affixed to at least two of said left side assembly, said right side assembly, said front assembly and said back assembly.

5. A container as in claim 1 wherein said second piece of sheet material is dimensioned to form a slip-fit with said rectangular tube.

6. A wooden container satisfying the performance requirements specified in Title 49, Part 178 of the United States Code of Federal Regulations, said wooden container comprising:

a bottom assembly;

each of a left side assembly and a right side assembly attached to said bottom assembly;

each of a front assembly and a back assembly attached to said bottom assembly and attached to each of said left side assembly and said right side assembly;

a top assembly attached to each of said left side assembly, said right side assembly, said front assembly and said back assembly;

each of said left side assembly, said right side assembly, said front assembly, said back assembly and said top assembly having a rectangular first piece of plywood, said first piece of plywood having a wood batten frame made from 1×4 stock affixed to the perimeter of a first face thereof and coincident with the edges thereof, said wood batten frame defined by long battens spanning the length of said first piece of plywood and short battens extending between and abutting said long battens, each said wood batten frame being glued to said first piece of plywood and further being stapled thereto by a plurality of staples driven through said first piece of plywood from a second face thereof opposite said first face;

said bottom assembly having a rectangular second piece of plywood with a rectangular wood base frame made from 1×4 stock and affixed to the perimeter of a bottom face thereof and extending beyond the perimeter thereof to form a circumferential extension dimensioned therearound to be equal to the thickness of said first piece of plywood plus the thickness of said 1×4 stock, said wood base frame defined by long supports spanning beyond the length of said second piece of sheet material and short supports extending between either ends of said long supports and abutting said long supports, said wood base frame being glued to said second piece of plywood and further being stapled thereto by another plurality of staples driven through said second piece of plywood from a top face thereof opposite said bottom face;

said left side assembly, said right side assembly, said back assembly and said front assembly arranged to form a rectangular tube having an inner surface defined by each said second face of each said first piece of plywood with said left side assembly being parallel to said right side assembly and said front assembly being parallel to said back assembly, wherein said left side assembly and said right side assembly are glued inside the perimeter of said front assembly and said back assembly such that external faces of said long battens and said short battens of said left side assembly and said right side assembly are coplanar with edges of said front assembly and said back assembly;

said second piece of plywood sized to form a slip-fit with said rectangular tube when said bottom assembly is positioned with said second piece of plywood fitting into said rectangular tube, wherein said circumferential extension abuts and is glued to lower portions of said left side assembly, said right side assembly, said front assembly and said back assembly;

said first piece of plywood of said top assembly abutting and glued to upper portions of said left side assembly, said right side assembly, said front assembly and said back assembly, wherein said long battens of said top assembly and said long supports of said bottom assembly are perpendicular to said long battens of said front assembly and said back assembly;

a first plurality of galvanized wood screws passing through said circumferential extension of said bottom assembly and further extending into said long battens at said lower portions of said left side assembly, said right side assembly, said front assembly and said back assembly;

a second plurality of galvanized wood screws passing through said long battens, said short battens and said first piece of sheet material of each of said front assembly and said back assembly, and further extending into said long battens and said short battens of said right side assembly and said left side assembly; and a third plurality of galvanized screws passing through said long battens, said short battens and said first piece of sheet material of said top assembly, and further extending into said long battens and said short battens at said upper portions of said left side assembly, said right side assembly, said front assembly and said back assembly.

7. A container as in claim 6 further comprising a handle affixed to at least two of said left side assembly, said right side assembly, said front assembly and said back assembly.

* * * * *